US005678870A

United States Patent [19]

Pelletier

[11] Patent Number: 5,678,870

[45] Date of Patent: Oct. 21, 1997

[54] REVERSIBLE MORTISE LOCK

[75] Inventor: Thomas A. Pelletier, Wallingford, Conn.

[73] Assignee: Sargent Manufacturing Company, New Haven, Conn.

[21] Appl. No.: 594,822

[22] Filed: Jan. 31, 1996

[51] Int. Cl.[6] ..... E05B 15/00; E05C 1/12

[52] U.S. Cl. ..... 292/244; 292/169.16; 292/245

[58] Field of Search ..... 292/244, 245, 292/144, 150, 169.15, 169.16, DIG. 24, DIG. 27

[56] References Cited

U.S. PATENT DOCUMENTS

| | | | |
|---|---|---|---|
| 1,393,911 | 10/1921 | Schumaker | 292/169.15 X |
| 1,706,486 | 3/1929 | Gasey | 292/169.15 X |
| 3,159,993 | 12/1964 | Crepinsek | 70/107 |
| 3,211,486 | 10/1965 | Crandell | 292/169.16 X |
| 3,361,462 | 1/1968 | Foster | 292/245 |
| 3,898,822 | 8/1975 | Schalm | 70/143 |
| 3,948,066 | 4/1976 | Solovieff | 70/129 |
| 4,286,812 | 9/1981 | Sprekeler | 292/245 |
| 4,390,197 | 6/1983 | Butts | 292/169.15 X |
| 4,529,234 | 7/1985 | Senften | 292/150 X |
| 4,536,020 | 8/1985 | Thomson | 292/173 |
| 4,583,382 | 4/1986 | Hull | 70/107 |
| 4,589,691 | 5/1986 | Foshee et al. | 292/150 X |
| 4,674,776 | 6/1987 | James | 292/150 X |
| 4,695,082 | 9/1987 | Marks | 292/169.16 |
| 4,696,174 | 9/1987 | Marks | 70/451 |
| 5,018,375 | 5/1991 | Tully | 70/472 |
| 5,083,122 | 1/1992 | Clark | 240/825.32 |
| 5,228,730 | 7/1993 | Gokcebay et al. | 292/144 |
| 5,421,178 | 6/1995 | Hamel et al. | 70/283 |
| 5,474,348 | 12/1995 | Palmer et al. | 292/339 |

*Primary Examiner*—Rodney M. Lindsey
*Attorney, Agent, or Firm*—DeLio & Peterson, LLC

[57] ABSTRACT

A reversible mortise lock comprising a casing, a latch bolt and a pair of spindle hubs disposed within the casing. Each spindle hub is independently pivotable about a fixed axis and has a slot. The latch bolt moves from an extended position to a retracted position in response to pivotal movement of either spindle hub. The latch bolt is rotable to a first orientation and to a second orientation. The reversible mortise lock further comprises an interfering member disposed within and accessible from outside the casing. The interfering member has a portion thereof sized for insertion into the spindle hub slots. The interfering member is pivotable to a first position corresponding to the first orientation of the latch bolt that allows only one of the hubs to pivot and to a second position corresponding to the second orientation of the latch bolt that allows only the other hub to pivot. The interfering member is pivotable from outside the casing without disassembling the reversible mortise lock.

18 Claims, 5 Drawing Sheets

REVERSIBLE MORTISE LOCK

BACKGROUND OF THE INVENTION

1. Field of the Invention

The present invention is related to reversible mortise locks.

2. Problem to be Solved

Mortise locks are typically designed to fit into an opening provided in the edge of a door opposite the edge that is hinged to the door frame. The lock generally includes a latch movable between an extended position, in which it projects beyond the edge of the door into an opening in the door frame to latch the door closed, and a retracted position, in which it permits opening of the door. Mortise locks also typically include a dead bolt that is movable between an extended position, in which it projects beyond the edge of the door into an opening in the door frame to lock the door, and a retracted position, in which it permits opening of the door. Mortise locks are typically configured so that the inner door knob can be rotated to retract the latch, and the outer door knob can be rotated to retract the latch or locked to prevent retraction of the latch.

A door may be hinged to a door frame along its left side edge or its right side edge. A conventional mortise lock mounted in the left edge of a door must be reversed when the lock is mounted in the right side edge of a door so that the inner and outer door knobs of a left-side mounted lock become the outer and inner door knobs, respectively, of a right-side mounted lock. Because the outer door knob is normally locked when the dead bolt is extended, while the inner door knob is not, this reversal requires that the operation of the mortise lock change to reverse its locking functions. Thus, adjustments must be made to the conventional mortise lock depending on whether it is mounted in a left-side or right-side orientation.

Adjustments to the conventional mortise lock are typically accomplished by partially or totally disassembling the mortise lock and rearranging or configuring the mortise lock components to achieve the desired mode of operation. However, the task of disassembling the mortise lock is a time consuming process. Furthermore, disassembling the mortise lock provides opportunities for damaging the components. Additionally, components may become lost during the adjustment process. If replacement components are not available, the mortise lock will have to be replaced.

Therefore, it is an object of the present invention to overcome these problems by providing a new and improved reversible mortise lock in which the housing does not have to be opened in order to reverse the door knob operation.

It is another object of the present invention to provide a new and improved mortise lock in which components need not be removed from the mortise lock in order to reverse the door knob operation.

Still other objects and advantages of the invention will in part be obvious and will in part be apparent from the specification.

SUMMARY OF THE INVENTION

The above and other objects, which will be apparent to those skilled in the art, are achieved in the present invention which is directed to, in a first aspect, a reversible mortise lock comprising:

a) a casing having a front plate for confronting a door frame and having a pair of opposed sidewalls, the front plate having an opening;

b) a latch bolt movable with respect to the casing between an extended position and a retracted position, the latch bolt projecting from the casing through the front plate opening when the latch bolt is in the extended position, the latch bolt being substantially completely withdrawn into the casing when the latch bolt is in the retracted position, the latch bolt being rotatable to a first orientation and to a second orientation;

c) a pair of spindle hubs disposed within the casing, each of which being independently pivotable about a fixed axis and having a slot, the latch bolt moving from the extended position to the retracted position in response to pivotal movement of either spindle hub; and d) an interfering member disposed within and accessible from outside the casing and having a portion thereof sized for insertion into the spindle hub slots, the interfering member being pivotable to a first position corresponding to the first orientation of the latch bolt that allows only one of the hubs to pivot and to a second position corresponding to the second orientation of the latch bolt that allows only the other hub to pivot.

In a related aspect, the present invention is directed to a reversible mortise lock comprising:

a) a casing having a front plate for confronting a door frame and a pair of opposed sidewalls, the front plate having an opening;

b) a latch bolt movable with respect to the casing between an extended position and a retracted position, the latch bolt projecting from the casing through the front plate opening when the latch bolt is in the extended position, the latch bolt being substantially completely withdrawn into the casing when the latch bolt is in the retracted position, the latch bolt being rotatable to a first orientation and to a second orientation;

c) a pair of spindle hubs disposed with the casing, each of which being independently pivotable about a fixed axis and having a slot, the latch bolt moving from the extended position to the retracted position in response to pivotal movement of either spindle hub;

d) an interfering member disposed within the casing and pivotable to at least two positions, the interfering member having a portion thereof adapted for insertion into either or both of the spindle hub slots to prevent movement of one or both of the spindle hubs, the axis about which the interfering member pivots is substantially perpendicular to the pivotal axis of the spindle hubs; and e) the interfering member being accessible through an opening in the casing, and pivotable without disassembling the reversible mortise lock.

In a further aspect, the present invention is directed to a reversible mortise lock comprising:

a) a casing having a front plate for confronting a door frame and having a pair of opposed sidewalls, the front plate having an opening;

b) a latch bolt movable with respect to the casing between an extended position and a retracted position, the latch bolt projecting from the casing through the front plate opening when the latch bolt is in the extended position, the latch bolt being substantially completely withdrawn into the casing when the latch bolt is in the retracted position, the latch bolt being rotatable to a first orientation corresponding to a left hand door and to a second orientation corresponding to a right hand door;

c) a pair of spindle hubs disposed within the casing, each of which being independently pivotable about a fixed axis and having a slot, the latch bolt moving from the extended position to the retracted position in response to pivotal movement of either spindle hub in a predetermined direction; and d) an interfering member disposed within the casing the interfering member having a portion thereof sized for insertion into the spindle hub slots, the interfering member being pivotable to a first position corresponding to the first orientation that allows only one of the hubs to pivot and to a second position corresponding to the second orientation that allows only the other hub to pivot, the interfering member being accessible from outside the casing and pivotable without disassembling the reversible mortise lock.

BRIEF DESCRIPTION OF THE DRAWINGS

The features of the invention are believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

In describing the preferred embodiment of the present invention, reference will be made herein to FIGS. 1–9 of the drawings in which like numerals refer to like features of the invention.

Figure 1:
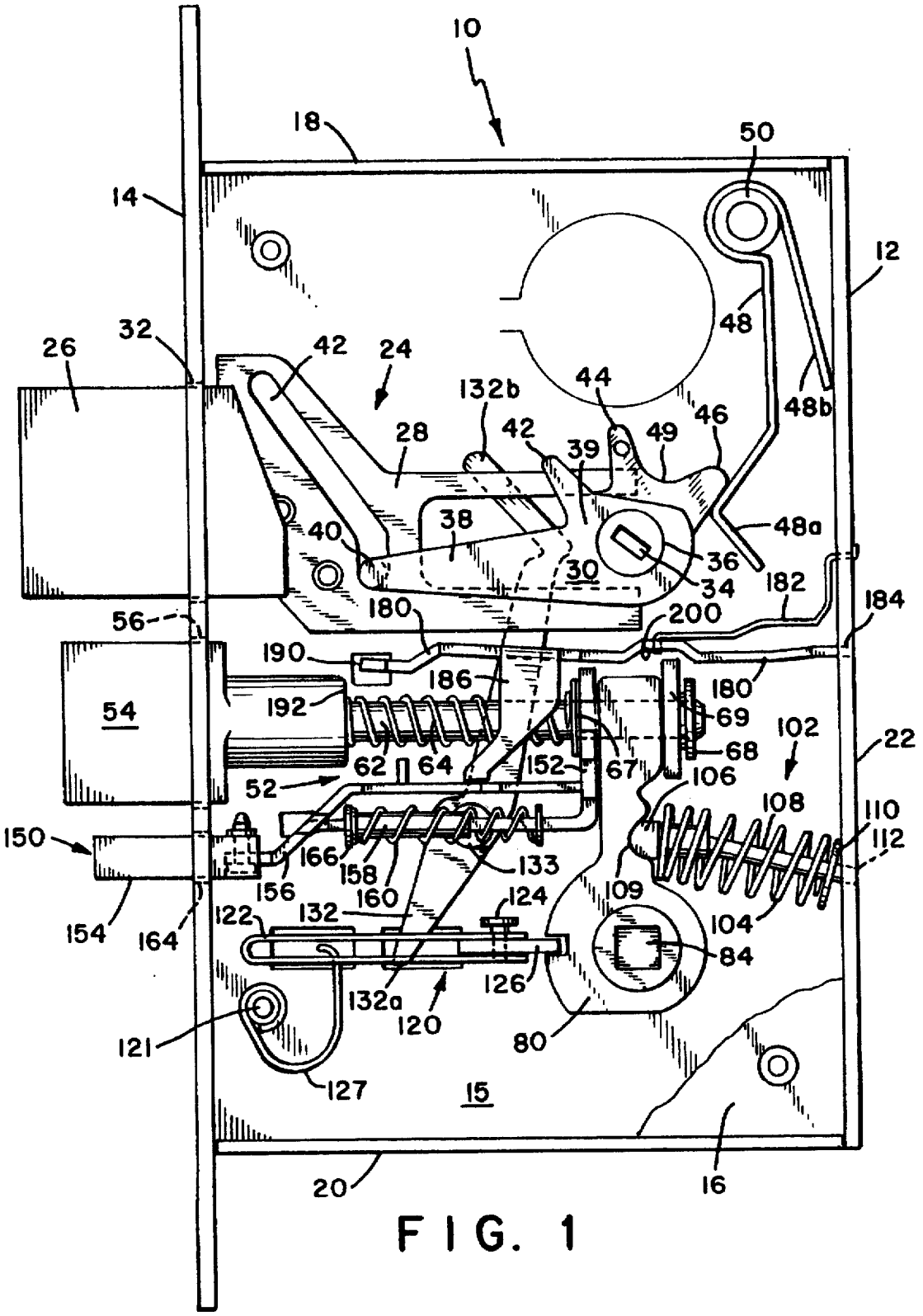
FIG. 1 is a side elevational view of the reversible mortise lock assembly of the present invention, a sidewall of the lock not being shown to facilitate viewing of the internal components of the reversible mortise lock.

Referring to FIG. 1, reversible mortise lock 10 of the present invention comprises casing 12 within which the lock components are enclosed. Casing 12 includes front plate 14, opposed sidewalls 15 and 16, top and bottom walls 18 and 20, respectively, and rear wall 22. Front plate 14 confronts a door frame, as described below.

Referring to FIG. 1, lock 10 further comprises a dead bolt mechanism 24. Dead bolt mechanism 24 comprises dead bolt 26, dead bolt bracket 28 and dead bolt arm 30. Dead bolt 26 is movable within opening 32 in front plate 14 and between a locked position and an unlocked position. When dead bolt 26 is in the locked position, dead bolt 26 projects from casing 12 through opening 32 in front plate 14. When dead bolt 26 is in the unlocked position, dead bolt 26 is substantially completely withdrawn into casing 12.

Referring to FIG. 1, dead bolt arm 30 is pivotally attached between opposing sidewalls 15 and 16. Dead bolt arm 30 is pivoted by a key (not shown) which is inserted into key slot 34 of key receptacle 36 which extends through dead bolt arm 30. Dead bolt arm 30 comprises elongate portion 38 and hub portion 39. Elongate portion 38 has tab 40 attached at the distal end thereof and is slideable within slot 42 of dead bolt bracket 28. Hub portion 39 includes fingers 42, 44 and 46. Dead bolt spring 48 is coiled about post 50 and comprises portion **48*a* which contacts finger 46 and portion 48*b* which contacts rear wall 22. FIG. 1 illustrates dead bolt mechanism 24 configured such that dead bolt 26 is in the locking position. When dead bolt 26 in the locking position, portion 48*a* of spring 48 contacts and applies a force to finger 46 of hub portion 39 to maintain dead bolt 26 in the locking position. When dead bolt arm 30 is pivoted by the key to configure dead bolt 26 in the unlocked position, such pivoting action creates a force sufficient to position portion 48*a* of spring 48 to area 49 of hub portion 39. Portion 48*a* of spring 48 contacts and applies a force to area 49 of hub portion 39 to maintain dead bolt 26** in the unlocked position.

Referring to FIG. 1, lock 10 further comprises latch bolt mechanism 52. Mechanism 52 comprises latch bolt 54 movable within opening 56 in front plate 14 and between an extended position and a retracted position. When latch bolt 54 is in the extended position, latch bolt 54 projects from casing 12 through opening 56. When latch bolt 54 is in the retracted position, latch bolt 54 is substantially completely withdrawn into casing 12. Referring to FIGS. 1, 3D, 4 and 5, latch bolt 54 defines an interior region 60 therein. Latch bolt mechanism 52 further comprises rod 62, spring 64, spring 65, washer 67 and plate 69. Spring 64 is disposed over rod 62 and interposed between latch bolt 54 and washer 67 so as to maintain an abutting relationship between flanged end 68 and plate 69. Rod 62 is inserted through opening 59 of latch bolt 54 and has a flanged end head 66 located within interior region 60. Rod 62 also has flanged end 68 adjacent plate 69. Spring 65 is disposed over the portion of rod 62 located within interior region 60 and is interposed between head 66 and interior wall 70 of latch bolt 54. Pin 72 is inserted across head 66 to attach head 66 to spring 65. Plate 69 is slidably mounted on rod 62 and is positioned between flanged end 68 of rod 62 and upper portions 88 and 92 of spindle hubs 80 and 82, respectively, which are discussed below. The purpose of plate 69 will also be discussed below.

Figure 4:
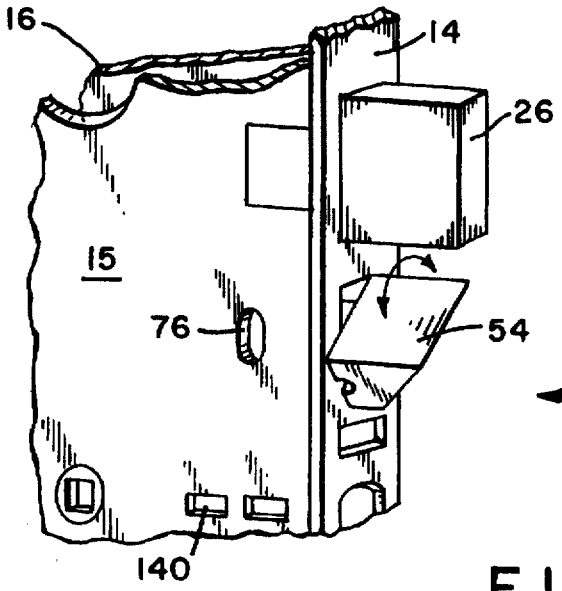
FIG. 4 is a perspective view of the reversible mortise lock assembly showing rotation of a latch bolt shown in FIG. 1.
Figure 5:
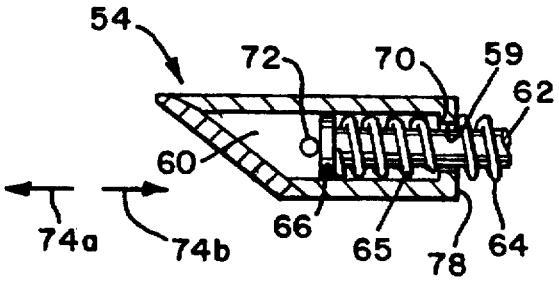
FIG. 5 is a side elevational view, in cross-section, of the latch bolt assembly.

Latch bolt 54 is able to rotate 360° upon rod 62 (see FIG. 4). Spring 65 allows latch bolt 54 to move longitudinally with respect to rod 62, as indicated by arrows **74*a* and 74*b* in FIG. 5. Spring 65 permits latch bolt 54 to longitudinally move between a normal, first position wherein edge 78 of latch bolt 54 is within casing 12, and an extreme position wherein edge 78 clears front plate 14 allowing latch bolt 54** to be rotated as shown in FIG. 4.

Thus, latch bolt 54 may be rotated to a first orientation, corresponding to when lock 10 is mounted on a left edge of a door, or rotated 180° to a second orientation corresponding to when lock 10 is mounted on a right edge of a door.

Opening 76 is formed in the casing sidewall to allow the user of lock 10 to change orientations of latch bolt 54. The user inserts a screw driver or similar device into opening 76 forcing latch bolt 54 to move with respect to rod 62 and in the direction indicated by arrow 74*a* in FIG. 5. When edge 78 of latch bolt 54 clears front plate 14, the user may rotate latch bolt 54 (see FIG. 4) to the desired orientation. Once latch bolt 54 is in the desired orientation, the user may remove the instrument from opening 76 to allow spring 65 to pull latch bolt 54 back in the direction indicated by arrow 74*b* in FIG. 5.

Referring to FIGS. 1, 2, 3A and 3B, lock 10 further comprises spindle hubs 80 and 82. Spindle hubs 80 and 82 are mounted for rotation about axis A. Each spindle hub is rotatable or pivotable independently of the other spindle hub. Spindle hub 80 has a square shaped opening 84 therein which is coaxial with axis A and receives a corresponding spindle attached to a door knob or lever. Similarly, spindle hub 82 has a square shaped opening (not shown) coaxial with axis A and receives a corresponding spindle attached to a door knob or lever. Thus, the rotational forces or torque produced by rotating the door knobs or levers is transmitted to spindle hubs 80 and 82. Spindle hub 80 has lower portion 86 and upper portion 88. Similarly, spindle hub 82 has lower portion 90 and upper portion 92. Spindle hub 80 has slot 94 formed in lower portion 86. Similarly, spindle hub 82 has slot 96 formed in lower portion 90. Slots 94 and 96 are coplanar and are substantially perpendicular to the axes 98 and 99 of spindle hubs 80 and 82, respectively. Referring to FIGS. 3C and 3D, each spindle hub 80 and 82 may be pivoted or rotated in the direction indicated by arrow 100. Referring to FIG. 1, spindle hubs 80 and 82 are shown in normal positions without any rotational force or torque transmitted thereto. Spring cartridge assembly 102 urges spindle hubs 80 and 82 in a direction opposite the direction indicated by arrow 100. Thus, when no rotational forces are applied to spindle hubs 80 and 82, spring cartridge assembly 102 maintains hubs 80 and 82 in the normal position shown in FIG. 1. When either of the spindle hubs 80 and 82 are rotated or pivoted in the direction indicated by arrow 100, the upper portions 88 and 92 of hubs 80 and 82, respectively, contact plate 69. Since plate 69 abuts flanged end 68 of rod 64, rod 64 is retracted in the direction indicated by arrow 74*b* which results in latch bolt 54 being withdrawn into casing 12.

Figure 2:
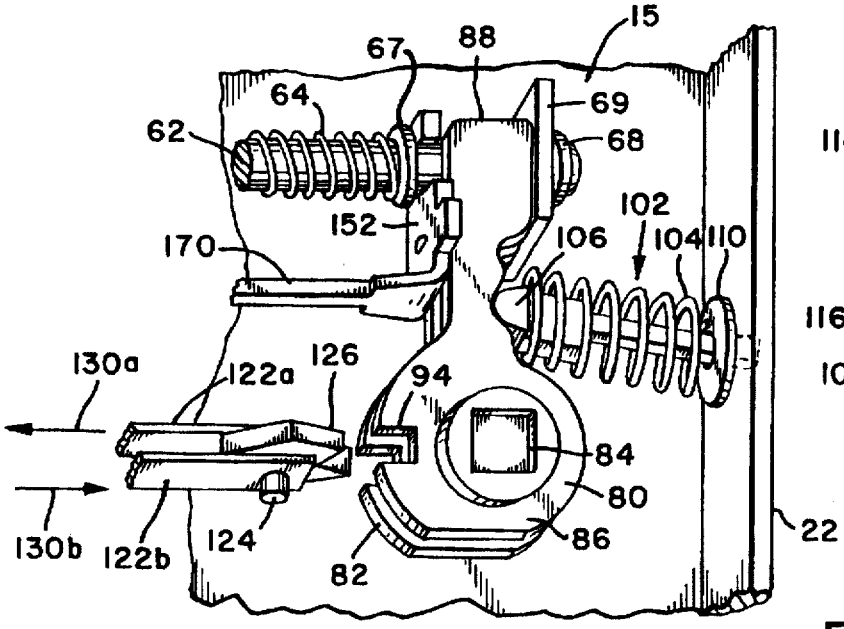
FIG. 2 is a perspective view of a pair of spindle hubs shown in FIG. 1.
Figure 3A:
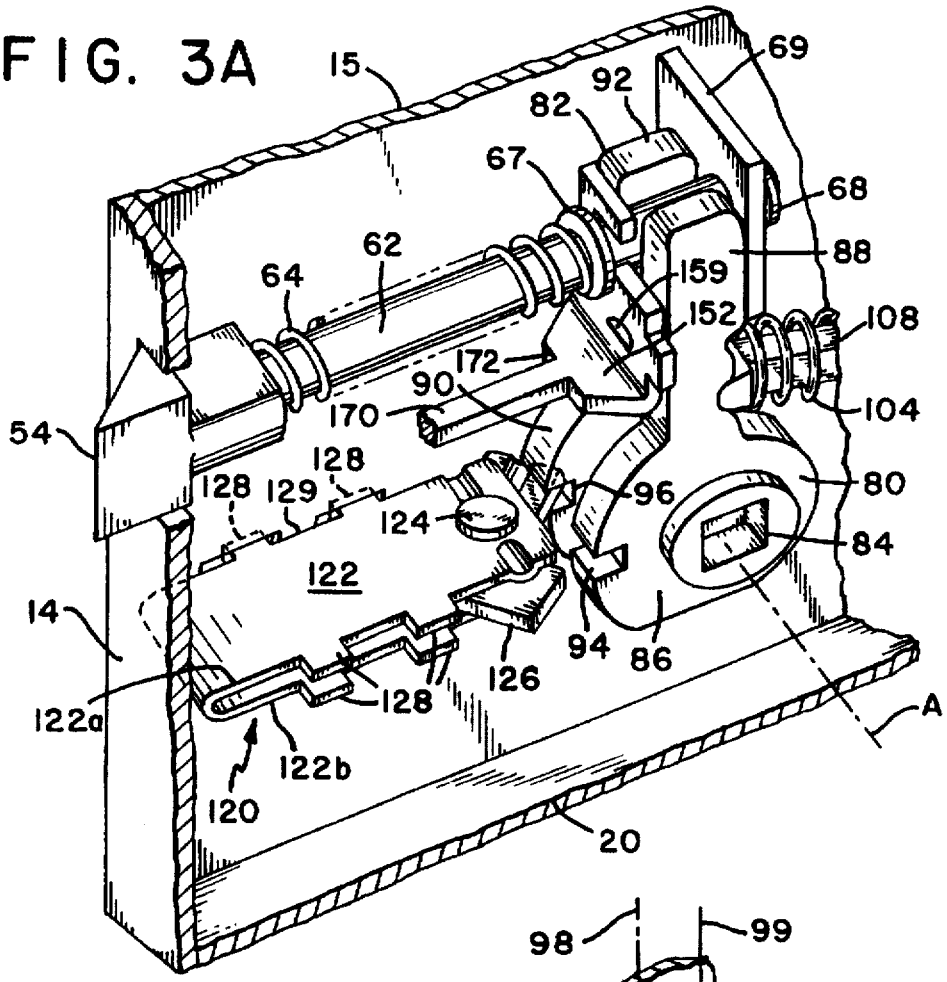
FIGS. 3A–3D are perspective views showing the interaction of the spindle hubs with the interfering member shown in FIGS. 1 and 2B–2D.
Figure 3B:
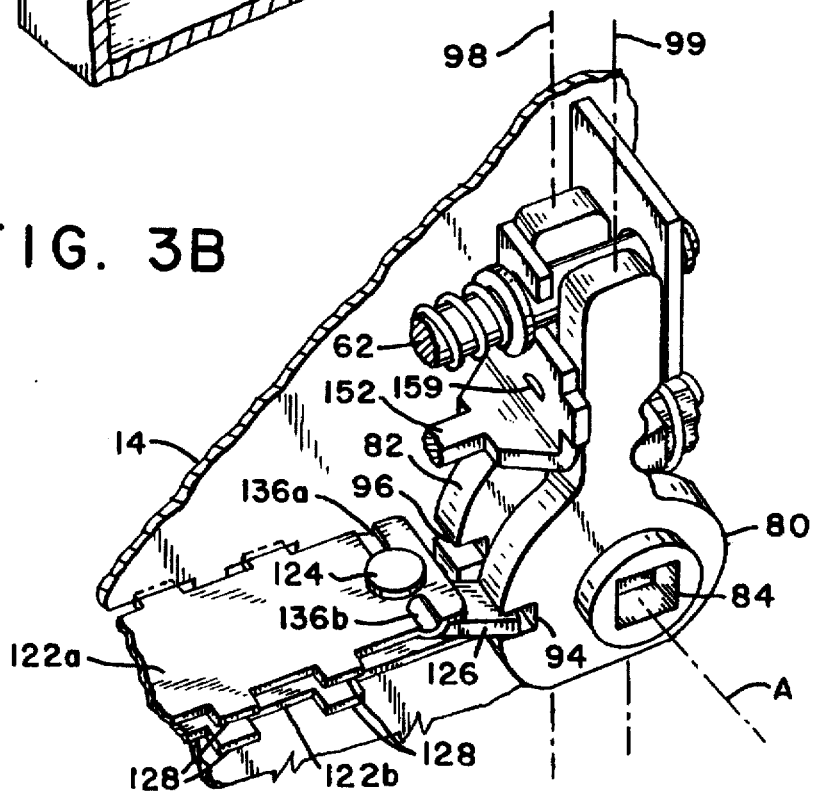
Figure 3C:
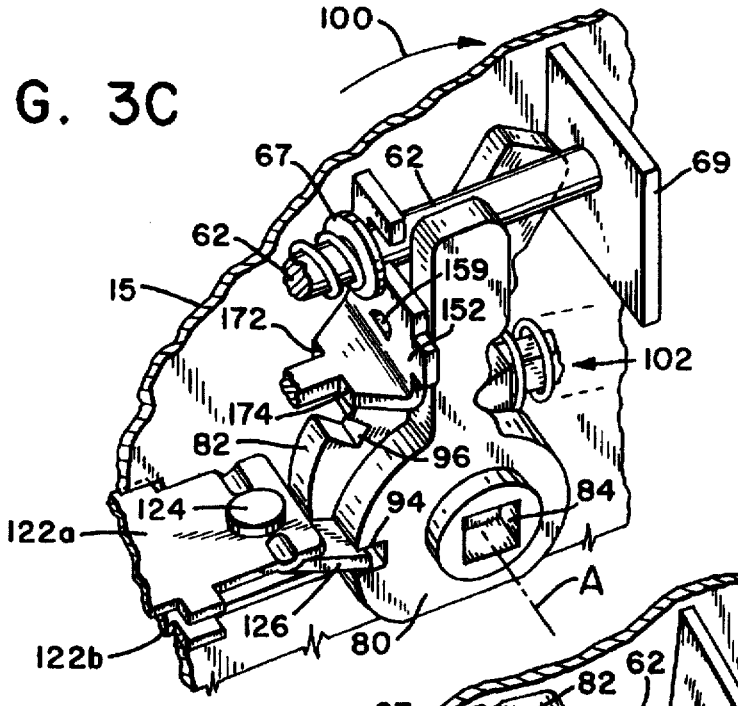
Figure 3D:
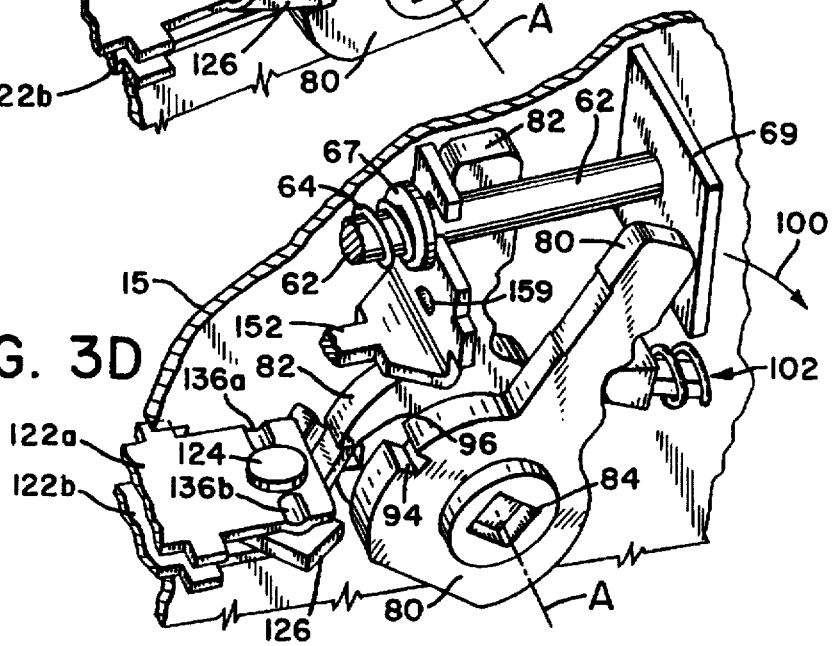

Referring to FIGS. 1 and 2, spring cartridge assembly 102 comprises spring 104, follower 106, guide 108 and washer 110. Follower 106 is slidably mounted upon guide 108. End 112 of guide 108 is pivotally engaged with rear wall 22 of casing 12. Washer 110 is mounted on guide 108 and abuts rear wall 22. Spring 104 is interposed between follower 106 and washer 110 and thus urges spindle hubs 80 and 82 in a direction opposite arrow 100 and into an abutting relationship with bracket 152 which is further discussed below. Such a configuration prevents the handle or levers from drooping and also returns the handles to their original position prior to being actuated or rotated. Spindle hubs 80 and 82 are spaced apart by a spacer (not shown) to allow guide 108 to pass between the hubs when one or both of the hubs 80 and 82 are rotated or pivoted.

As shown in FIGS. 1 and 2, spindle hub 80 has a radiused female formation 109. Similarly, spindle hub 82 has an identical radiused female formation (not shown). Follower 106 has a radiused edge to conform to the female formations formed on spindle hubs 80 and 82. Such a configuration significantly reduces wear due to the friction resulting from the constant contact between follower 106 and the female formations and also increases the cycle life of these components.

Figure 2A:
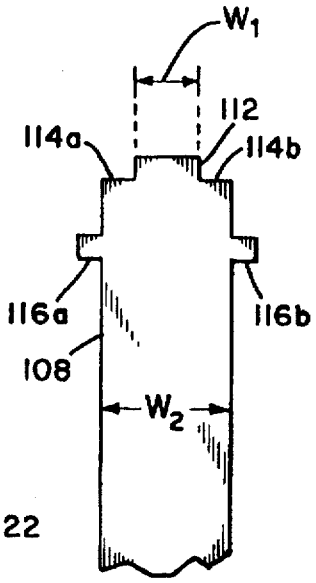
FIG. 2A is a partial, top plan view of a guide shown in FIG. 1.

As described above, end 112 of guide 108 is pivotally engaged with rear wall 22 of casing 12. Guide 108 has a substantially rectangular cross-section. FIG. 2A shows a partial, top plan view of guide 108. End 112 of guide 108 has a width W1. The remaining portion of guide 108 has a width W2 which is greater than width W1. End 112 is loosely positioned in a substantially rectangular shaped opening in casing 12 while edges 114*a* and 114*b* abut rear wall 22. Washer 110 abuts extended portions 116*a* and 116*b*. Since spring 104 is interposed between washer 110 and follower 106, spring 104 exerts a force on washer 110 thereby maintaining the pivotal engagement between guide end 112 and the opening in rear wall 22 that receives end 112. Such a configuration reduces manufacturing costs since a pivot pin is not required.

Referring to FIGS. 1–3A, lock 10 of the present invention further comprises locking assembly 120. Assembly 120 comprises retainer 122, pivot pin 124, interfering member or locking piece 126 and spring wire 127. Retainer 122 is positioned between and slidably attached to opposed sidewalls 15 and 16 via inserts 128. Retainer 122 is comprises of one piece of material folded over upon itself to provide sides 122*a* and 122*b* and a space therebetween. In a preferred embodiment, retainer 122 is comprised of sheet metal. Interfering member 126 is pivotally positioned between sides 122*a* and 112*b* via pivot pin 124. In a preferred embodiment, interfering member 126 is fabricated from steel or iron. Spring wire 127 is mounted to post 121 and is engaged with retainer 122.

Referring to FIG. 1, retainer 122 is movable in the direction indicated by arrows 130*a* and 130*b* via arm 132. Arm 132 is pivotally attached to sidewall 15 at pivot point 133 and has lower end 132*a* and upper end 132*b*. Lower end 132*a* is disposed within space 129 between inserts 128. Upper end 132*b* is engaged with a rear finger (not shown) installed on bracket 28 such that when dead bolt 26 is being positioned in the locking position, the rear finger of dead bolt arm 30 contacts end 132*b* of arm 132 causing end 132*a* to move retainer 122 in the direction indicated by arrow 130*b*. When retainer 122 moves the maximum distance in the direction indicated by arrow 130*b*, interfering member 126 is shifted into either slot 94 or 96 or both. Spring wire 127 maintains retainer 122 in this position until dead bolt 26 is configured in the unlocked position. As dead bolt 26 is being positioned in the unlocked position, bracket 28 contacts and moves end 132*b* of arm 132 such that end 132*a* of arm 132 moves retainer 122 in the direction indicated by arrow 130*a* to move interfering member 126 away from slots 94 and 96 of spindle hubs 80 and 82, respectively.

Figure 2B:
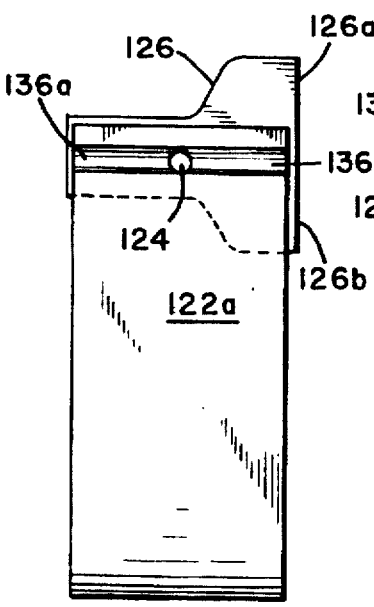
FIGS. 2B–2D are top plan views illustrating the various orientations of an interfering member shown in FIGS. 1 and 3A–3D.
Figure 2C:
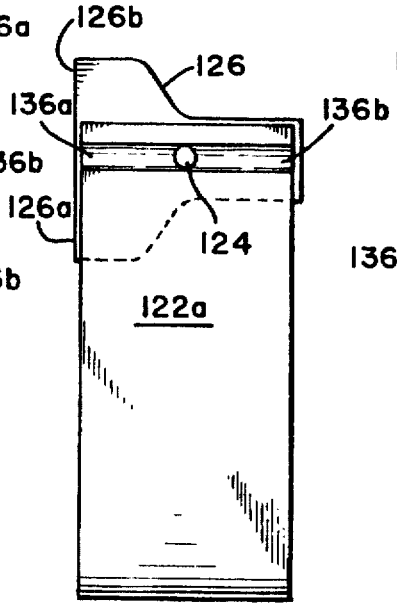
Figure 2D:
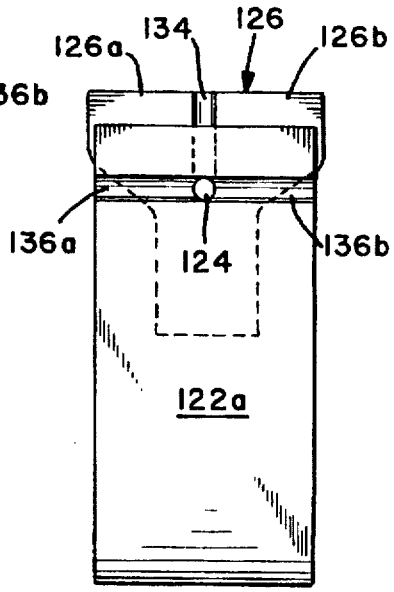

Referring to FIGS. 2B–2D, 3B and 3C, interfering member 126 is substantially planar and has portions 126*a* and 126*b*. Interfering member 126 also has recess or depression 134 which is configured to receive protrusions 136*a* and 136*b* formed in side 122*a* of retainer 122. Interfering member 126 can pivot to the three positions shown in FIGS. 2B–2D. Referring to FIG. 2B, member 126 is pivoted such that portion 126*a* is exposed and that protrusion 136*b* is frictionally positioned within depression 134. When dead bolt 26 is in the locked position and portion 126*a* is exposed as shown in FIG. 2B, arm 132 is positioned such that retainer 122 moves in the direction indicated by arrow 130*b* thereby positioning portion 126*a* of interfering member 126 within slot 94 of spindle hub 80 (see FIG. 3B) to prevent rotation of spindle hub 80. Thus, only spindle hub 82 is able to rotate (see FIG. 3C). Similarly, when dead bolt 126 is in the locked position and interfering member 126 is pivoted 180° to expose portion 126*b* as shown in FIG. 2C, portion 126*b* is positioned within slot 96 of spindle hub 82 to prevent spindle hub 82 from rotating (see FIG. 3D). A sufficient amount of force is needed to pivot member 126 to the position shown in FIGS. 2B and 2C to order to dislodge protrusions 136a and 136b from depression 134. When dead bolt 26 is in the locking position and interfering member 126 is pivoted as shown in FIG. 2D, portions 126a and 126b of interfering member 126 are positioned within slots 94 and 96 of spindle hubs 80 and 82, respectively, to prevent spindle hubs 80 and 82 from rotating. Access to interfering member 126 may be had through opening 140 in sidewall 15 and a similar opening (not shown) in sidewall 16 (see FIG. 5). The user may insert an instrument, such as a screwdriver, to pivot interfering member 126 to any of the positions shown in FIGS. 2B–2D. Thus, disassembly of the lock 10 is not necessary to pivot interfering member 126.

Referring to FIGS. 1, 6A, 6B and 7, lock 10 of the present invention further comprises guard bolt assembly 150. Assembly 150 comprises bracket 152, which is attached to sidewall 15 of casing 12, guard bolt 154, guard bolt guide 156, spring guide 158 and spring 160. Guard bolt 154 is movable with respect to casing 12 between a normal, extended position and a retracted or depressed position. When guard bolt 154 is in the extended position, guard bolt 154 projects from opening 164 in front plate 14. When guard bolt 154 is in the depressed position, guard bolt 154 is substantially completely withdrawn into casing 12. Guard bolt guide 156 has upwardly extending projection 162 which contacts latch bolt 54 when latch bolt 54 is retracted within casing 12 by the rotation or pivoting of either spindle hubs 80 and 82 in the direction indicated by arrow 100. Projection 162 also contacts latch bolt 54 when latch bolt 54 is depressed into casing 12 due to contact with a door frame. Guard bolt guide 156 further includes shaft 157 which is slidably disposed in opening 159 in bracket 152 to effect substantially straight or linear movement of latch bolt guide 156.

Referring to FIG. 1, spring guide 158 is hollow and has a substantially cylindrical shape. Spring guide 158 has an opening adjacent flanged end 166 of guide 158 and receives projection 168 of guard bolt guide 156. Spring guide 158 has an opening at the end opposite flanged end 166 and receives portion 170 of bracket 152 (see FIG. 3A). Spring guide 158 is slidably mounted upon portion 170. Spring 160 is mounted upon spring guide 158 and portion 170 and is interposed between flanged end 166 and shoulder portions 172 and 174 of bracket 152. Spring 160 exerts a force upon flanged end 166 so as to maintain guard bolt 154 in its normal, extended position.

Referring to FIG. 1, guard bolt assembly 150 further comprises guard lever 180 and guard lever spring 182. End 184 of guard lever 180 is pivotally mounted to rear wall 22 in the same manner as end 112 of guide 108 discussed above. Guard lever 180 moves vertically between an uppermost position and a lowermost position. When guard lever 180 is in the uppermost position, latch bolt 54 is able to be depressed (by contact with a door frame) into casing 12, and when guard lever 180 is in the lowermost position, latch bolt 54 cannot be depressed into casing 12 but may be retracted by rotation of spindle hubs 80 or 82. Referring to FIGS. 1, 6A, 6B and 7, guard lever 180 includes arm 186. When guard bolt 154 is in the extended position, extended portion 188 of guard bolt guide 156 contacts arm 186 and moves arm 186 to its uppermost position. When guard bolt 154 is withdrawn into casing 12, extended portion 188 no longer contacts arm 186 thereby allowing spring 182 to force guard lever 180 to its lowermost position. When guard lever 180 is in the lowermost position; end 190 contacts rear side 192 of latch bolt 54 to prevent latch bolt 54 from being depressed into casing 12. Referring to FIG. 1, guard lever 182 has a indentation 200 which receives plate 69. Thus, rotation of either spindle hub 80 and 82 will cause plate 69 to move arm 182 to the uppermost position thereby allowing latch bolt 54 to be retracted. Thus, latch bolt 54 may still be retracted into casing 12 by rotation of spindle hubs 80 and 82 even when guard bolt 154 is depressed into casing 12.

Figure 6A:
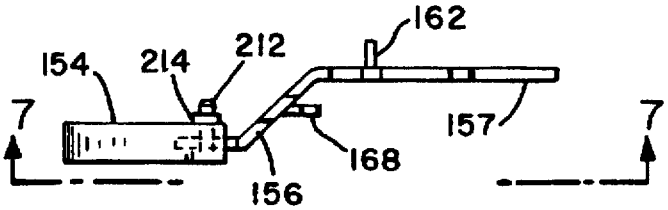
FIG. 6A is a side elevational view of a guard bolt assembly shown in FIG. 1.
Figure 6B:
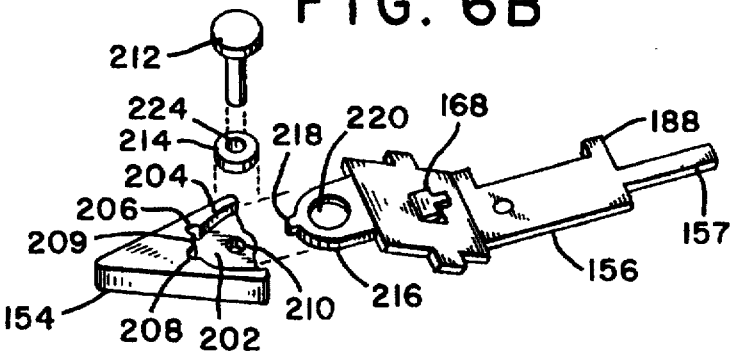
FIG. 6B is a perspective, exploded view of the guard bolt assembly shown in FIG. 6A.
Figure 7:
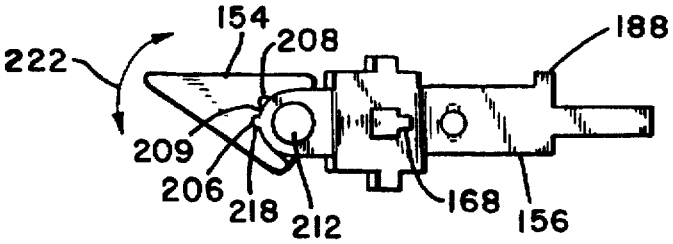
FIG. 7 is a view taken along line 7—7 in FIG. 6A.

Referring to FIGS. 6A, 6B and 7, guard bolt 154 is pivotally attached to guard bolt guide 156 and pivotable between two extreme positions, each of which corresponding to one of the orientations to which latch bolt 54 can rotate. Guard bolt 54 has a cut-out portion defining engagement surface 202. Engagement surface 202 is bordered by wall 204 which has female formations 206 and 208 separated by ridge 209. Each female formation corresponds to one of the two extreme positions to which guard bolt 154 can pivot. Guard bolt 154 has opening 210 for receiving the pin 212. Head 216 of guard bolt guide 156 is shaped to conform to engagement surface 202 and wall 204 of guard bolt 154. Head 216 has projection or male formation 218 sized for insertion into either of female formations 206 and 208. Head 216 also has opening 220 for receiving pin 212 and resilient grommet 214. FIG. 6A shows guard bolt 154 and guard bolt guide 156 in the same orientation elevational view as in FIG. 1. However, in order to facilitate description of the cooperation of guard bolt 154, guard bolt guide 156, pin 212 and groin met 214, FIG. 6B shows an upside-down elevational view of the aforementioned components. As shown in FIG. 7, which is a view taken along line 7—7 in FIG. 6A, guard bolt 154 can pivot in the directions indicated by arrow 222 to one extreme position, defined by the insertion of male formation 218 into female formation 206, and another extreme position defined by the insertion of male formation 218 into female formation 208. Grommet 214 is preferably fabricated from resilient material such as rubber. Grommet 214 is sized for frictional placement within opening 220. Grommet 214 has central opening 224 sized for receiving pin 212 in a friction relationship. The resiliency of grommet 214 allows pivoting of guard bolt 154 such that male formation 218 frictionally traverse ridge 209 when moving between female formations 206 and 208.

Figure 8:
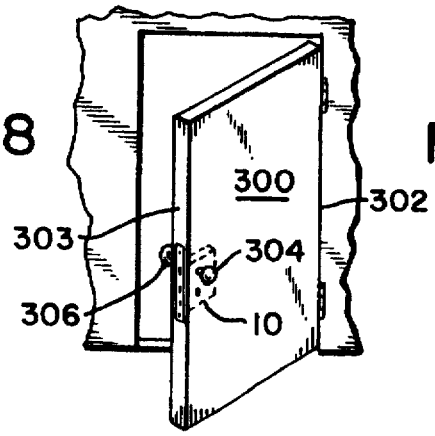
FIG. 8 is a perspective view of a "left hand" door hinged to a door frame along the right side of the door.

Referring to FIG. 8, door 300 is being viewed from the inside. Door 300 is hinged along its right side 302. Lock 10 of the present invention is mounted on the left edge or left hand side of door 300 (a "left-hand" oriented door). Door knobs 304 and 306 are attached to corresponding spindles that are inserted into the openings in the spindle hubs 80 and 82. Therefore, for a "left hand" door 300, it is desirable to have inner door knob 304 rotatable at all times and outer door knob 306 rotatable only when dead bolt 26 is in the unlocked position. Thus, the user pivots interfering member 126 to the configuration shown in FIG. 2C. As described above, the user may pivot interfering member 126 by inserting a suitable instrument through opening 140 without disassembling lock assembly 10 of the present invention. In addition to adjusting the position of interfering member 126, the user also rotates latch bolt 54, as described above, and pivots guard bolt 154, as described above, to correspond to the orientation of interfering member 126. Thus, all adjustments to interfering member 126, latch bolt 54 and guard bolt 154 may be accomplished without disassembling lock 10.

Figure 9:
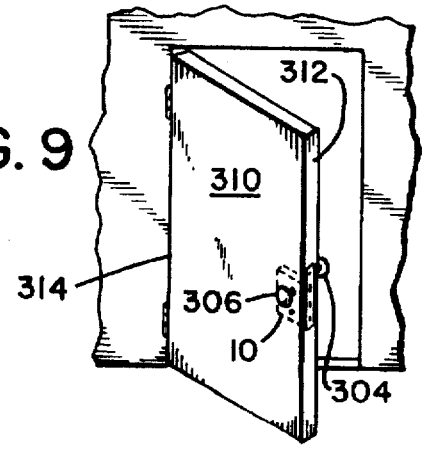
FIG. 9 is a perspective view of a "right hand" door hinged to a door frame along the left side of the door.

Referring to FIG. 9, door 310 is being viewed from the inside. Door 310 is configured to open from the right side 312 since it is hinged along left side 314 (a "right hand"

oriented door). Lock 10 of the present invention is again installed on door 310. However, it will be seen that inner door knob 304 is now the outer door knob and outer door knob 306 is now the inner door knob. If the user desires that door knob 306 function as the inner door knob in FIG. 8 (rotatable at all times) and door knob 304 function as the outer door knob in FIG. 8 (rotate only when dead bolt 26 in the unlocked position), then the user must configure interfering member 126 as shown in FIG. 2B by the process described above. The user must also rotate latch bolt 54 and pivot guard bolt 154 as described above to correspond to a right hand oriented door. As described and shown above, the adjustments made to interfering member 126, latch bolt 54 and guard bolt 154 may be made without disassembling lock 10.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A reversible mortise lock comprising:

a casing having a front plate for confronting a door frame and a pair of opposed sidewalls, the front plate having an opening;

a latch bolt movable with respect to the casing between an extended position and a retracted position, the latch bolt projecting from the casing through the front plate opening when the latch bolt is in the extended position, the latch bolt being substantially completely withdrawn into the casing when the latch bolt is in the retracted position, the latch bolt being rotatable to a first orientation and to a second orientation;

a pair of spindle hubs disposed with the casing, each of which being independently pivotable about a fixed axis and having a slot, the latch bolt moving from the extended position to the retracted position in response to pivotal movement of either spindle hub; and an interfering member disposed within the casing and pivotable to at least two positions, the interfering member having a portion thereof adapted for insertion into either or both of the spindle hub slots to prevent movement of one or both of the spindle hubs, the axis about which the interfering member pivots being substantially perpendicular to the pivotal axis of the spindle hubs;

the interfering member being accessible through an opening in the casing and pivotable without disassembling the reversible mortise lock.

2. The reversible mortise lock of claim 1 wherein both spindle hub slots are coplanar.

3. The reversible mortise lock of claim 2 wherein the fixed axis about which the spindle hubs pivot is coplanar with the slots.

4. The reversible mortise lock of claim 1 wherein each of the opposed sidewalls has an opening aligned with the interfering member to allow the interfering member to be pivoted from outside the casing without disassembling the reversible mortise lock.

5. The reversible mortise lock of claim 1 further comprising a retainer disposed within and attached to the casing, the interfering member being pivotally attached to the retainer.

6. The reversible mortise lock of claim 5 wherein: the interfering member is substantially planar and has a recess, and the retainer has a pair of projections, each of which sized for insertion into the recess, each projection corresponding to one of the positions to which the interfering member can pivot.

7. The reversible mortise lock of claim 1 further comprising a latch bolt rod disposed within the casing, the latch bolt being rotatably attached to one end of the latch bolt rod, the latch bolt being movable along the longitudinal axis of the latch bolt rod and between a normal first position and an extreme second position that allows rotation of the latch bolt with respect to the latch bolt rod and the casing.

8. The reversible mortise lock of claim 7 wherein the latch bolt has an interior region therein and an interior wall enclosing the interior region, the end of the latch bolt rod that is attached to the latch bolt being disposed within the interior region of the latch bolt, the reversible mortise lock further comprising a spring mounted on and attached to the end of the latch bolt rod, the spring being interposed between the end of the latch bolt rod and the interior wall of the latch bolt, the spring maintaining the latch bolt in the normal position but allowing movement to the extreme second position.

9. The reversible mortise lock of claim 1 further comprising a mechanism for urging the spindle hubs in a direction opposite the direction in which the spindle hubs pivot.

10. The reversible mortise lock of claim wherein each spindle hub has a radiused female formation, the mechanism comprising:

a contact member having a bore therethrough and a radiused male formation for contacting the radiused female formations of the spindle hubs;

a guide slidably disposed within the bore of the contact member, the guide having an end pivotally attached to the casing; and a spring interposed between the contact member and the casing to urge the spindle hubs in a direction opposite the direction in which the spindle hubs pivot.

11. The reversible mortise lock assembly of claim 1 further comprising a dead bolt movable with respect to the casing between a locked position and an unlocked position, when in the locked position, the dead bolt projecting from the casing, when in the unlocked position, the dead bolt being substantially completely withdrawn into the casing.

12. The reversible mortise lock of claim 11 further comprising a device for selectively positioning the dead bolt in the locked or unlocked position.

13. The reversible mortise lock of claim 11 further comprising a retainer disposed within and movably attached to the casing, the interfering member being pivotally attached to the retainer, the retainer being movable between a first position and a second position when the dead bolt is in the locked position and the unlocked position, respectively, when the retainer is in the first position, the interfering member is positioned in at least one of the spindle hub slots, when the retainer is in the second position, the interfering member is positioned away from the spindle hub slots.

14. The reversible mortise lock of claim 1 wherein the lock further comprises a guard bolt movable with respect to the casing between an extended position and a depressed position, the latch bolt being prevented from being depressed into the casing when the guard bolt is depressed.

15. The reversible mortise lock of claim 14 further comprising a guard bolt guide, the guard bolt being pivotally attached to the guard bolt guide and pivotable between a first position corresponding to the first orientation of the latch bolt and a second position corresponding to the second orientation of the latch bolt.

16. A reversible mortise lock comprising:

a casing having a front plate for confronting a door frame and having a pair of opposed sidewalls, the front plate having an opening;

a latch bolt movable with respect to the casing between an extended position and a retracted position, the latch bolt projecting from the casing through the front plate opening when the latch bolt is in the extended position, the latch bolt being substantially completely withdrawn into the casing when the latch bolt is in the retracted position, the latch bolt being rotatable to a first orientation and to a second orientation;

a pair of spindle hubs disposed within the casing, each of which being independently pivotable about a fixed axis and having a slot, the latch bolt moving from the extended position to the retracted position in response to pivotal movement of either spindle hub;

an interfering member disposed within and accessible from outside the casing and having a portion thereof sized for insertion into the spindle hub slots, the interfering member being pivotable to a first position corresponding to the first orientation of the latch bolt that allows only one of the hubs to pivot and to a second position corresponding to the second orientation of the latch bolt that allows only the other hub to pivot;

a guard bolt movable with respect to the casing between an extended position and a depressed position, the latch bolt being prevented from being depressed into the casing when the guard bolt is depressed; and a guard bolt guide, the guard bolt being pivotally attached to the guard bolt guide and pivotable between a first position corresponding to the first orientation of the latch bolt and a second position corresponding to the second orientation of the latch bolt, the guard bolt including an engagement surface having a pair of female formations separated by a ridge formation and the guard bolt guide including a male formation sized for insertion into the female formations, the male formation being inserted into one of the female formations when the latch bolt is pivoted to its first position, the male formation being inserted into the other female formation when the latch bolt is pivoted to its second position.

17. The reversible mortise lock of claim 16 wherein the engagement surface of the guard bolt has a centrally located opening and the guard bolt guide has an opening aligned with the opening in the engagement surface, the reversible mortise lock further comprising:

a resilient annular member having a central opening and sized for frictional placement within the opening in the guard bolt guide; and a pivot pin disposed within the guard bolt guide opening and frictionally disposed in the central opening of the resilient member;

the resilient member allowing slight movement of the guard bolt with respect to the guard bolt guide to allow the male formation to frictionally traverse the ridge separating the female formations.

18. A reversible mortise lock comprising:

a casing having a front plate for confronting a door frame and having a pair of opposed sidewalls, the front plate having an opening;

a latch bolt movable with respect to the casing between an extended position and a retracted position, the latch bolt projecting from the casing through the front plate opening when the latch bolt is in the extended position, the latch bolt being substantially completely withdrawn into the casing when the latch bolt is in the retracted position, the latch bolt being rotatable to a first orientation and to a second orientation;

a pair of spindle hubs disposed within the casing, each of which being independently pivotable about a fixed axis and having a slot, the latch bolt moving from the extended position to the retracted position in response to pivotal movement of either spindle hub; and an interfering member disposed within and accessible from outside the casing and having a portion thereof sized for insertion into the spindle hub slots, the interfering member being pivotable to a first position corresponding to the first orientation of the latch bolt that allows only one of the hubs to pivot and to a second position corresponding to the second orientation of the latch bolt that allows only the other hub to pivot, the interfering member also being pivotal to a third position wherein the portion of the interfering member is positioned within both spindle hub slots to prevent pivotal movement of the hubs.

* * * * *

UNITED STATES PATENT AND TRADEMARK OFFICE

CERTIFICATE OF CORRECTION

PATENT NO. : 5,678,870

DATED : October 21, 1997

INVENTOR(S) : Thomas A. Pelletier

It is certified that error appears in the above-identified patent and that said Letters Patent is hereby corrected as shown below:

Col. 8, line 29; delete "groin met" and insert - - grommet - -.

Col. 10, line 28; insert - - 9 - - after the word claim.

Signed and Sealed this

Twenty-first Day of April, 1998

Bruce Lehman

*Attest:*

BRUCE LEHMAN

*Attesting Officer*

*Commissioner of Patents and Trademarks*